US005492262A

United States Patent [19]

Pascarelli

[11] Patent Number: 5,492,262

[45] Date of Patent: Feb. 20, 1996

[54] DEVICE FOR SUPPORTING A PLURALITY OF NAILS IN A COUPLED FASHION FOR AUTOMATICALLY FEEDING SUCH NAILS FROM A CONTAINER

[76] Inventor: Douglas A. Pascarelli, 201 McKinley Dr., Mastic Beach, N.Y. 11951

[21] Appl. No.: 240,566

[22] Filed: May 11, 1994

[51] Int. Cl.[6] ..... B25C 1/04

[52] U.S. Cl. ..... 227/136

[58] Field of Search ..... 227/120, 135, 227/136, 137, 139; 206/820

[56] References Cited

U.S. PATENT DOCUMENTS

| | | | |
|---|---|---|---|
| 3,708,097 | 1/1973 | Fisher | 227/136 |
| 3,854,648 | 12/1974 | Inzoli et al. | 227/136 |
| 4,014,488 | 3/1977 | Potacek et al. | 227/136 |
| 4,149,297 | 4/1979 | Monacelli | 227/136 |

*Primary Examiner*—Scott A. Smith

[57] ABSTRACT

A device for supporting a plurality of nails in a coupled fashion for automatically feeding such nails from a container comprising: a housing for supporting and feeding nails therefrom, the housing having a generally circular central portion and a linear portion extending therefrom at a tangent, the housing being provided with a spiral slot along the length thereof from the exterior end of the tangential portion to adjacent the center of the circular portion, the cross-section of the device of the spiralling portion of the device including a generally rectangular section with a vertical height essentially equal to the vertical height of the nails to be supported and a width substantially equal to the diameter of the nails to be supported, the cross-section also including an upper transverse slot formed as an extension of the rectangular section at the upper end thereof for supporting the head of nails to be transported, the device including upper and lower side rails extending outwardly from the end of the linear portion on the both sides thereof with generally, c-shaped clips on the outboard ends thereof; the housing adapted to receive, support and feed a plurality of nails.

3 Claims, 4 Drawing Sheets

DEVICE FOR SUPPORTING A PLURALITY OF NAILS IN A COUPLED FASHION FOR AUTOMATICALLY FEEDING SUCH NAILS FROM A CONTAINER

BACKGROUND OF THE INVENTION

1. Field of the Invention

The present invention relates to device for supporting a plurality of nails in a coupled fashion for automatically feeding such nails from a container and more particularly pertains to supporting and feeding nails from a container holding such nails in a coupled fashion.

2. Description of the Prior Art

The use of supporting and feeding devices of various constructions is known in the prior art. More specifically, supporting and feeding devices of various constructions heretofore devised and utilized for the purpose of supporting and feeling various objects are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. No. 4,096,982 to Stahl discloses an automatic multi nail dispenser.

U.S. Pat. No. 4,195,762 to Burton discloses a nail dispensing nozzle assembly.

U.S. Pat. No. 4,403,725 to Lawrence discloses a nail holding and directing device.

U.S. Pat. No. 4,830,246 to Ryan discloses a farrier's nail-holding device.

U.S. Pat. No. 4,926,718 to Cook discloses a nail holding tool.

In this respect, the device for supporting a plurality of nails in a coupled fashion for automatically feeding such nails from a container according to the present invention substantially departs from the conventional concepts and designs of the prior art, and in so doing provides an apparatus primarily developed for the purpose of supporting and feeding nails from a container holding such nails in a coupled fashion.

Therefore, it can be appreciated that there exists a continuing need for new and improved device for supporting a plurality of nails in a coupled fashion for automatically feeding such nails from a container which can be used for supporting and feeding nails from a container holding such nails in a coupled fashion. In this regard, the present invention substantially fulfills this need.

SUMMARY OF THE INVENTION

In view of the foregoing disadvantages inherent in the known types of nail supporting and feeding devices of various constructions now present in the prior art, the present invention provides an improved device for supporting a plurality of nails in a coupled fashion for automatically feeding such nails from a container. As such, the general purpose of the present invention, which will be described subsequently in greater detail, is to provide a new and improved device for supporting a plurality of nails in a coupled fashion for automatically feeding such nails from a container apparatus and method which has all the advantages of the prior art and none of the disadvantages.

To attain this, the present invention essentially comprises a new and improved device for supporting a plurality of nails in a coupled fashion for automatically feeding such nails from a container comprising, in combination a housing for supporting and feeding nails therefrom, the housing having a generally circular central portion and a linear portion extending therefrom at a tangent, the housing being provided with a spiral slot along the length thereof from the exterior end of the tangential portion to adjacent the center of the circular portion, the cross-section of the device of the spiralling portion of the device including a generally rectangular section with a vertical height essentially equal to the vertical height of the nails to be supported and a width substantially equal to the diameter of the nails to be supported, the cross-section also including an upper transverse slot formed as an extension of the rectangular section at the upper end thereof for supporting the head of nails to be transported, the device including upper and lower side rails extending outwardly from the end of the linear portion on the both sides thereof with generally, c-shaped clips on the outboard ends thereof; a plurality of nails positionable within the slot, the nails having a body with a point at the lower end and a head at the upper end, the body adapted to be positioned in the rectangular section and the head adapted to the position within the transverse slot, the nails also having coupling components therebetween perpendicular to the bodies of the nails at an intermediate extent thereof, the nails extending from the clips to the interior of the spiral; a drive means including a piston like driver within the housing interior of the nails and a coil spring interior thereof of the driver to provide a motive force to urge the nails to, c-shaped clips; and straps secured to the exterior surface of the housing for coupling with the arm of a user.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved device for supporting a plurality of nails in a coupled fashion for automatically feeding such nails from a container which has all the advantages of the prior art nail supporting and feeding devices of various constructions and none of the disadvantages.

It is another object of the present invention to provide a new and improved device for supporting a plurality of nails in a coupled fashion for automatically feeding such nails from a container which may be easily and efficiently manufactured and marketed.

It is a further object of the present invention to provide a new and improved device for supporting a plurality of nails in a coupled fashion for automatically feeding such nails from a container which is of a durable and reliable construction.

An even further object of the present invention is to provide a new and improved device for supporting a plurality of nails in a coupled fashion for automatically feeding such nails from a container which is susceptible of a low cost of manufacture with regard to both materials and labor, and which accordingly is then susceptible of low prices of sale to the consuming public, thereby making such nail supporting and feeding devices of various constructions economically available to the buying public.

Still yet another object of the present invention is to provide a new and improved device for supporting a plurality of nails in a coupled fashion for automatically feeding such nails from a container which provides in the apparatuses and methods of the prior art some of the advantages thereof, while simultaneously overcoming some of the disadvantages normally associated therewith.

Still another object of the present invention is to support and feed nails from a container holding such nails in a coupled fashion.

Lastly, it is an object of the present invention to provide a new and improved device for supporting a plurality of nails in a coupled fashion for automatically feeding such nails from a container comprising a housing for supporting and feeding nails therefrom, the housing having a generally circular central portion and a linear portion extending therefrom at a tangent, the housing being provided with a spiral slot along the length thereof from the exterior end of the tangential portion to adjacent the center of the circular portion, the cross-section of the device of the spiralling portion of the device including a generally rectangular section with a vertical height essentially equal to the vertical height of the nails to be supported and a width substantially equal to the diameter of the nails to be supported, the cross-section also including an upper transverse slot formed as an extension of the rectangular section at the upper end thereof for supporting the head of nails to be transported, the device including upper and lower side rails extending outwardly from the end of the linear portion on the both sides thereof with generally, c-shaped clips on the outboard ends thereof; the housing adapted to receive, support and feed a plurality of nails.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numeral refers to the same part thought the various figures.

DESCRIPTION OF THE PREFERRED EMBODIMENT

Figure 1:
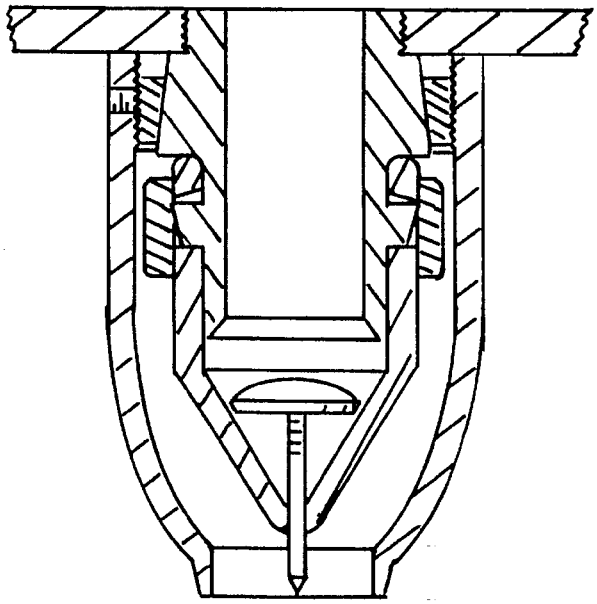
FIG 1 PRIOR ART
FIG. 1 is cross-sectional view of a nail supporting and feeding device constructed in accordance with the prior art.
Figure 2:
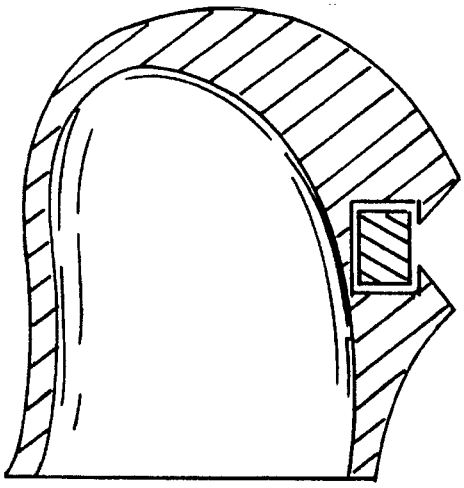
FIG 2 PRIOR ART
FIG. 2 is an additional prior art device adapted for holding and feeding nails.
Figure 3:
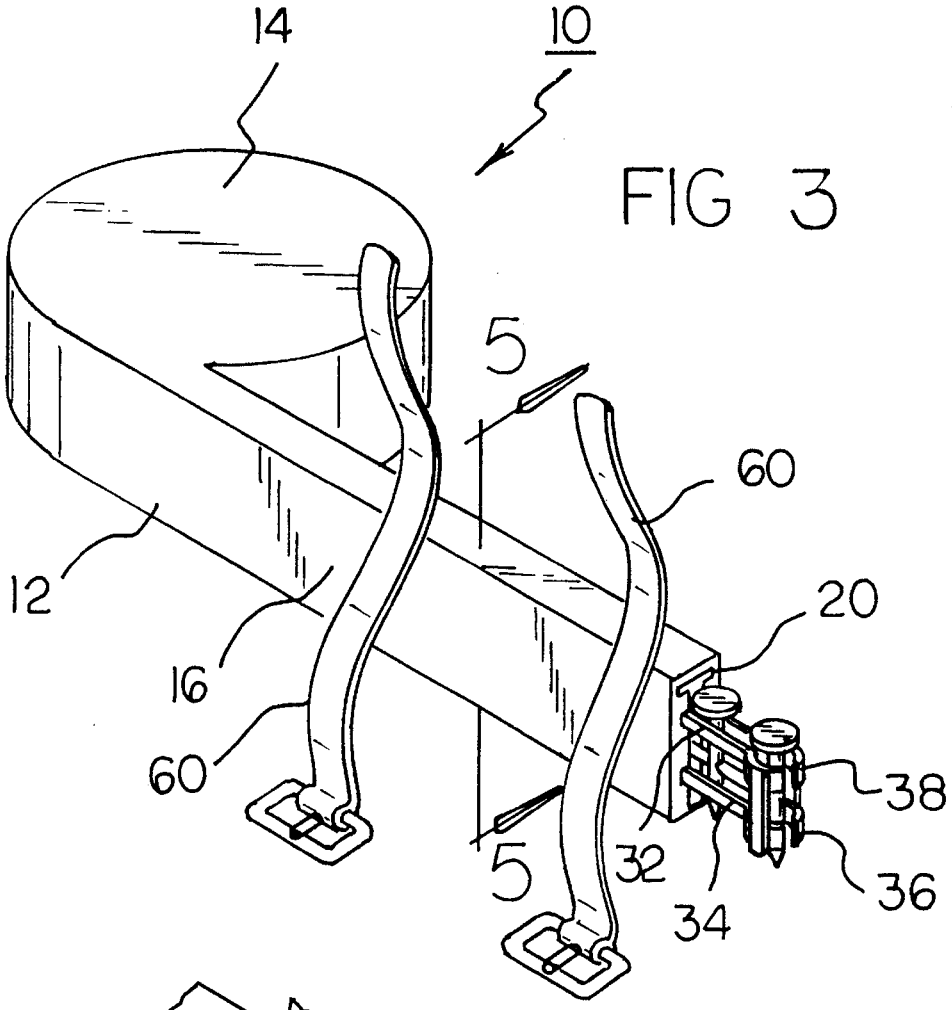
FIG. 3 is a perspective illustration of the new and improved device for supporting a plurality of nails in a coupled fashion for automatically feeding such nails from a container constructed in accordance with the principles of the present invention.
Figure 4:
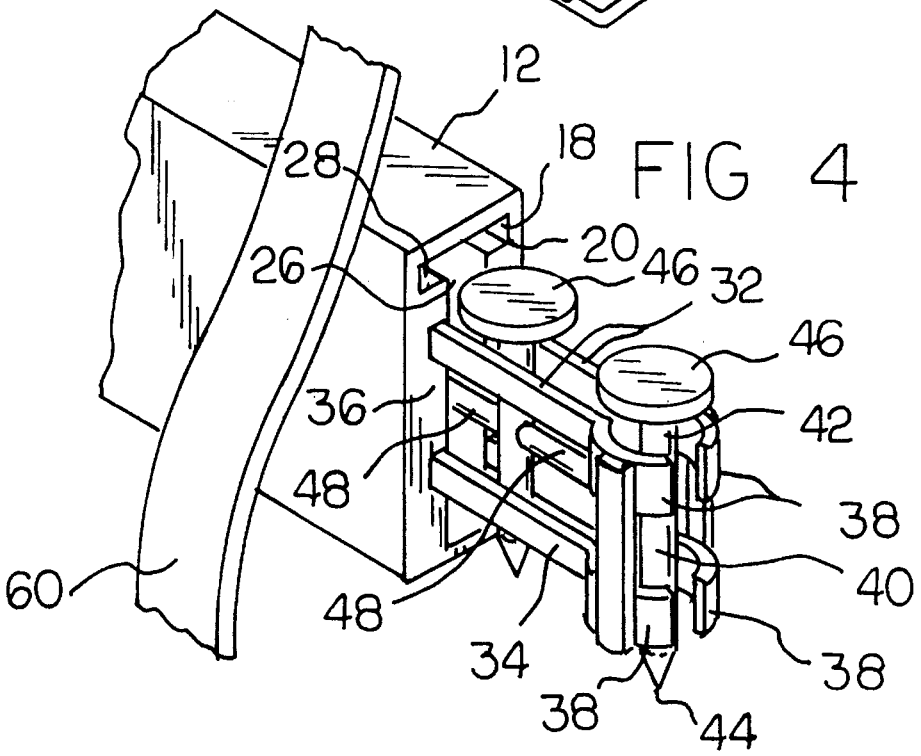
FIG. 4 is an enlarged perspective showing of the output end of the device shown in FIG. 3 with two nails exposed.
Figure 5:
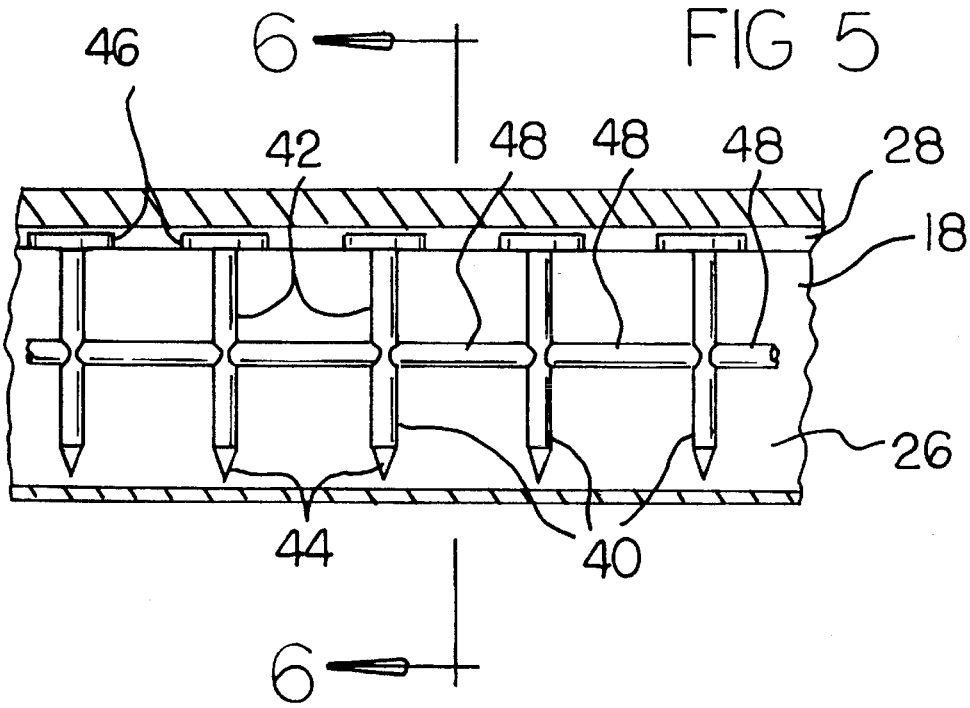
FIG. 5 is a cross-sectional view of the interior of the housing illustrating a plurality of nails in operative position for being supported and fed.

With reference now to the drawings, and in particular to FIG. 1 thereof, a new and improved device for supporting a plurality of nails in a coupled fashion for automatically feeding such nails from a container embodying the principles and concepts of the present invention and generally designated by the reference numeral 10 will be described.

The present invention, the new and improved device for supporting a plurality of nails in a coupled fashion for automatically feeding such nails from a container is a system 10. In its broadest context, such system is comprised of a plurality of components including a housing, nails, a drive means and straps. Such components are individually configured and correlated with respect to each other so as to attain to the desired objectives. More specifically, the central component of the system is a housing 12. The housing is adapted for supporting and feeding nails therefrom. The housing has a generally circular central portion 14 and a linear portion 16 extending therefrom at a tangent. The housing is provided with a slot 18. The slot is spiral in its configuration and extends along the length of the housing from the exterior end 20 of the tangential linear portion to an interior region adjacent to the center 22 of the circular portion.

Figure 6:
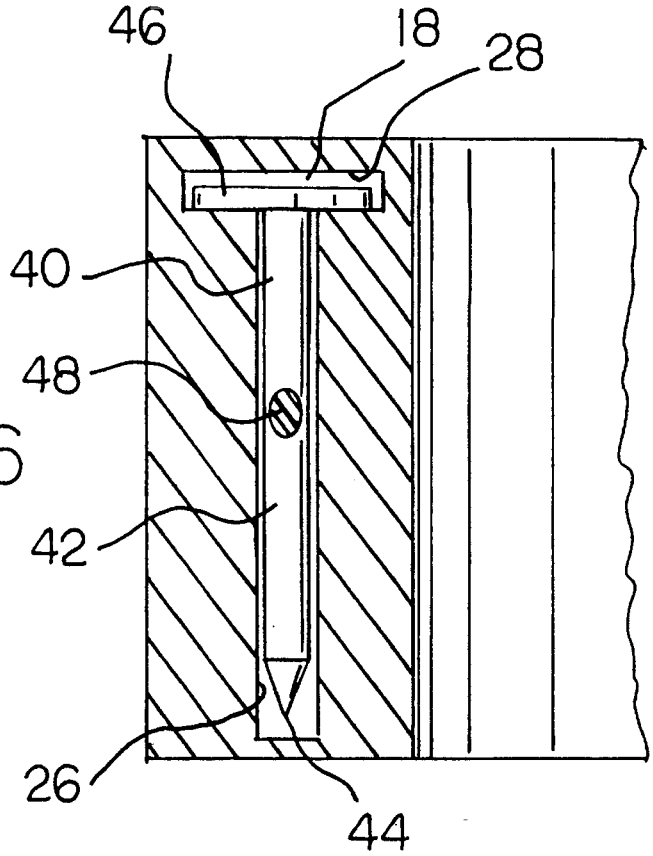
FIG. 6 is a cross-sectional view of the support structure and nails taken along line 6—6 of FIG. 5.

The cross-section of the device is best seen in FIG. 6. Such cross-section of the device including both the circular and linear portions includes a generally rectangular section 26. The vertical height is essentially equal to the vertical height of the nails to be supported and fed. The width of the section is substantially equal to the diameter of the nails to be supported. The cross-section also includes an upper transverse slot 28. Such slot is formed as an extension of the rectangular section at the upper end thereof. The transverse slot is for supporting the heads of nails to be transported.

The device also includes upper and lower side rails 32 and 34 extending outwardly from the end 36 of the linear portion. Such rails are located on both sides of the slot and terminate in generally c-shaped clips 38. Such clips are located at the outboard ends of the side rails. They are of such shape as to provide a retarding force to the nails as they are fed from interior of the housing.

Next provided are a plurality of nails 40. The nails are 42 with a point 44 at the lower end. The upper end of the body has a head 46. The body is adapted to be positioned in the rectangular section of the housing. The head is adapted to be positioned within the transverse slot of the housing. The nails also have coupling components 48 therebetween. Such coupling components are located along a common axis perpendicular to the axes of the bodies of the nails. They are located at an intermediate extent along the length of such nails. The nails extend from the c-shaped clips inwardly to the interior of the spirals.

Figure 7:
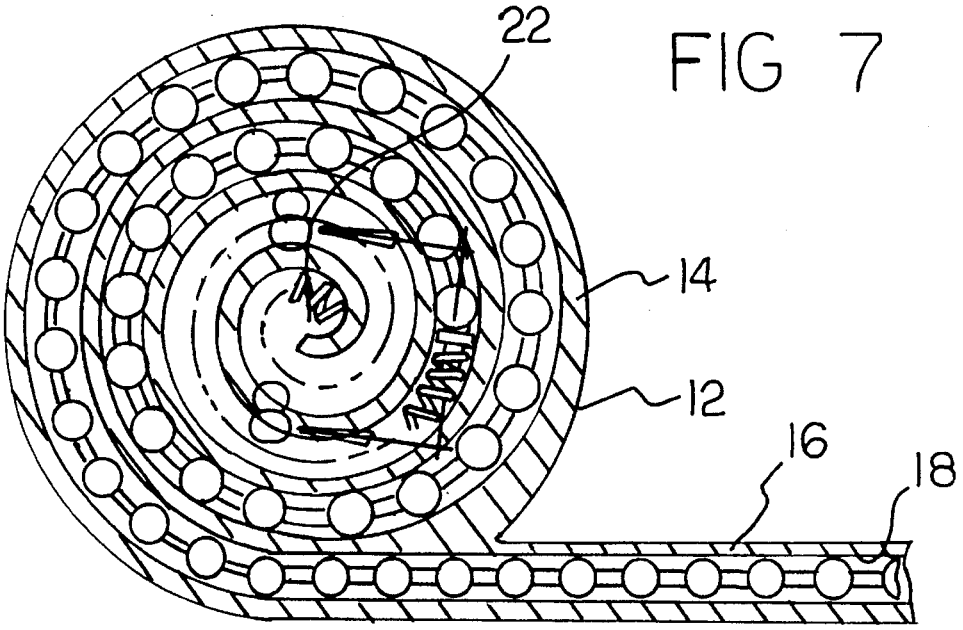
FIG. 7 is a cross-sectional view of the support housing for the nails taken essentially therethrough perpendicular to the axis.
Figure 8:
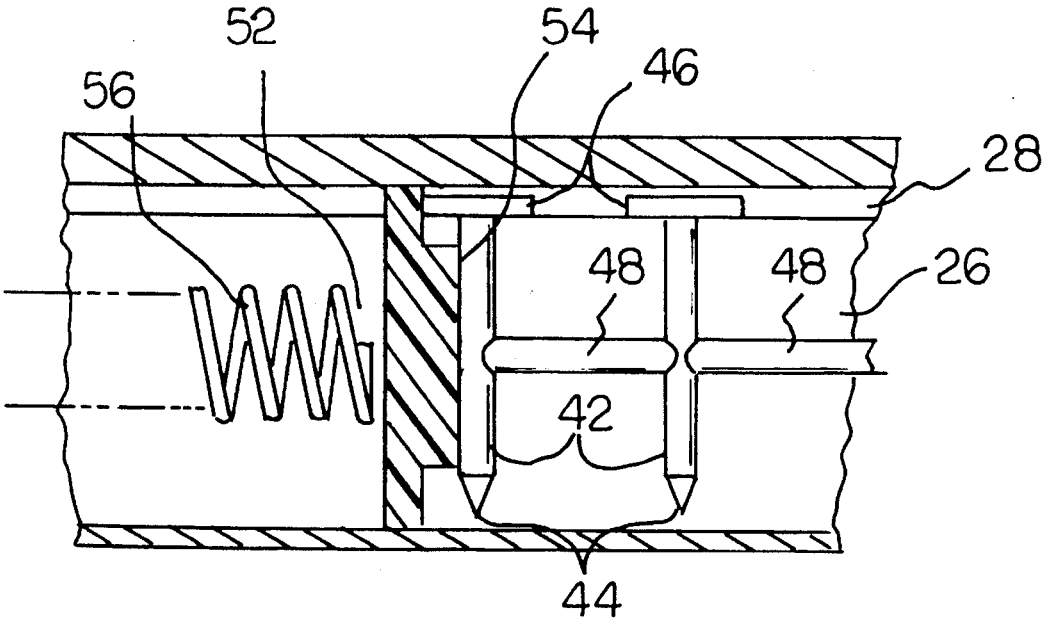
FIG. 8 is a cross-sectional view of a portion of the device taken along line 8—8 of FIG. 7.

The nails are driven out of the slot of the housing by a drive means 52. Such drive means include a piston like driver 54. Such driver is shaped to contact the trailing edge of the last nail within the slot. Note FIGS. 7 and 8. The drive means also include a coil spring 56. The coil spring is located interior of the driver to provide the motive forth necessary to urge the nails out of the housing into contact with the c-shaped clips.

The last component of the system is a pair of straps 60. The straps are secured to the exterior surface of the housing. Such straps are adapted for coupling the housing to the arm of the user.

The present invention dispenses nails and holds them in a vertical position, ready to be struck with a hammer. It is a tool which is intended for use by a carpenter, roofer, and anyone who may be required to drive a large quantity of nails. The present invention is not to be confused with a nailing tool, which presents and drives a nail each time the trigger is pulled. Those tools are air driven so they have an air hose attached and require a compressor to supply the air. In addition to being very expensive and awkward to handle, they are very heavy and will slide off an inclined surface like a roof. Self contained units are also available. They are not encumbered by a hose, but have the same problems of high price, weight, and sliding.

This dispenser contains a coil of nails installed in a spring loaded housing that feeds the strip through a chute, delivering one nail at a time to two sets of positioning clips. One set holds the nail just below the head, and the other grips it near the tip. The nail is moved into position and is tapped with a hammer to set it and releases it from the clips. After the nail has been set, the present invention is moved away, permitting the nail to be driven freely, until seated. Another nail is automatically moved into the clips by spring action.

The present invention is strapped at an angle to the wrist and the forearm, permitting both hands to be free. It is made of steel and plastic and could be available in two models, one for common nails and the other for finishing nails. Both would be adjustable to accept various lengths of nails.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved device for supporting a plurality of nails in a coupled fashion for automatically feeding such nails from a container comprising, in combination:

a housing for supporting and feeding nails therefrom, the housing having a generally circular central portion and a linear portion extending therefrom at a tangent, the housing being provided with a spiral slot along the length thereof from an exterior end of the tangential portion to adjacent the center of the circular portion, the cross-section of the spiralling portion of the device including a generally rectangular section with a vertical height essentially equal to the vertical height of the nails to be supported and a width substantially equal to the diameter of the nails to be supported, the cross-section also including an upper transverse slot formed as an extension of the rectangular section at the upper end thereof for supporting the head of nails to be transported, the device including upper and lower side rails extending outwardly from the end of the linear portion on the both sides thereof with generally, c-shaped clips on outboard ends thereof;

a plurality of nails positionable within the slot, the nails having a body with a point at a lower end and a head at an upper end, the body adapted to be positioned in the rectangular section and the head adapted to be positioned within the transverse slot, the nails also having coupling components therebetween perpendicular to the bodies of the nails at an intermediate extent thereof, the nails extending from the clips to the interior of the spiral;

a drive means including a piston like driver within the housing interior of the nails and a coil spring interior of the driver to provide a motive force to urge the nails toward said c-shaped clips; and straps secured to the exterior surface of the housing for coupling with the arm of a user.

2. A device for supporting a plurality of nails in a coupled fashion for automatically feeding such nails from a container comprising:

a housing for supporting and feeding nails therefrom, the housing having a generally circular central portion and a linear portion extending therefrom at a tangent, the housing being provided with a spiral slot along the length thereof from an exterior end of the tangential portion to adjacent the center of the circular portion, the cross-section of the spiralling portion of the device including a generally rectangular section with a vertical height essentially equal to the vertical height of the nails to be supported and a width substantially equal to the diameter of the nails to be supported, the cross-section also including an upper transverse slot formed as an extension of the rectangular section at the upper end thereof for supporting the head of nails to be transported, the device including upper and lower side rails extending outwardly from the end of the linear portion on the both sides thereof with generally, c-shaped clips on outboard ends thereof, and straps secured to the exterior surface of the housing for coupling with the arm of a user; the housing adapted to receive, support and feed a plurality of nails.

3. The device as set forth in claim 2 and further including: a drive means including a piston like driver within the housing interior of the nails and a spring interior thereof to provide a motive force to urge the driver nails toward the extension.

* * * * *